US006588929B1

(12) United States Patent
Dornbush

(10) Patent No.: US 6,588,929 B1
(45) Date of Patent: Jul. 8, 2003

(54) PORTABLE MIXING AND DISPENSING APPARATUS AND METHOD

(76) Inventor: Kelly N. Dornbush, 81 - 9th St., Cayucos, CA (US) 93430

( * ) Notice: Subject to any disclaimer, the term of this patent is extended or adjusted under 35 U.S.C. 154(b) by 27 days.

(21) Appl. No.: 09/668,414

(22) Filed: Sep. 22, 2000

(51) Int. Cl.[7] ..... B05B 9/047

(52) U.S. Cl. ..... 366/160.2; 366/160.4; 366/182.4; 222/250; 222/289; 239/313; 239/322; 137/564.5

(58) Field of Search ..... 137/564.5; 222/249, 222/250, 389; 239/322, 313; 366/173.1, 182.1–182.4, 162.3, 160.1–160.5

(56) References Cited

U.S. PATENT DOCUMENTS 547,725 A * 10/1895 Laurans et al.
716,910 A 12/1902 Lubbecke
801,612 A * 10/1905 Schramm
1,169,524 A 1/1916 Baker
1,297,622 A 3/1919 Whittaker
1,576,982 A * 3/1926 Mass
1,578,944 A 3/1926 Wilkinson
1,731,767 A 10/1929 Cramer
1,831,979 A 11/1931 Swett
2,206,089 A * 7/1940 Gray
2,398,369 A 4/1946 Garabedian
2,935,994 A 5/1960 Schwieger
3,198,438 A 8/1965 Hultgren
3,292,867 A 12/1966 Hunter
3,780,910 A 12/1973 Wagner
4,113,151 A 9/1978 Brown et al.
4,807,586 A 2/1989 Kao
5,163,584 A 11/1992 Huber et al.
5,203,507 A 4/1993 Musto et al.

* cited by examiner

*Primary Examiner*—Charles E. Cooley
*Assistant Examiner*—David Sorkin
(74) *Attorney, Agent, or Firm*—Leo F. Costello

(57) ABSTRACT

A portable mixing and dispensing apparatus, especially useful for spraying, including a fluid conducting, mixing and supporting framework for the hydraulic unit in the apparatus. The framework includes spaced end plates and a conduit assembly. Each end plate has a cylinder head portion forming part of the cylinder of the hydraulic unit, an upper mounting flange, and a lower flange. The conduit assembly includes an intermediate conduit/handle and a pair of end units. The end units are nearly identical and are secured to the end plates so as to constitute unitary structures therewith, releasably connected to opposite ends of the cylinder body of the hydraulic unit and to the intermediate conduit/handle, thereby enabling easy access to the cylinder body and piston in the body. Each end unit includes an outlet conduit and an end conduit. The end conduits extend through the upper flanges and slip into the conduit/handle in a sealed, fluid conducting connection, thereby also releasably mounting the conduit/handle on the end plates. One of the end conduits is capped and serves as an auxiliary supporting leg, and two other legs extend from the same end plate, the three legs supporting the apparatus during filling. An outlet fitting is connected to the other end conduit, and an outlet hose may be connected to the outlet fitting and wrapped around the upper flanges in notches thereof. The lower flanges serve as main supporting legs during use of the apparatus for spraying. A method is also provided for rapidly filling the apparatus with a spraying liquid.

29 Claims, 8 Drawing Sheets

PORTABLE MIXING AND DISPENSING APPARATUS AND METHOD

FIELD

The present invention pertains to a portable mixing and dispensing apparatus and method and more particularly to such an apparatus especially adapted for dispensing by spraying that includes a fluid conducting, mixing, and supporting framework for an hydraulic unit of such an apparatus that facilitates supporting, handling, servicing, and storing the apparatus in general and the hydraulic unit in particular and to a method for filling the apparatus.

BACKGROUND

Dual automatic mixing and spraying equipment of the type here involved conducts water under pressure, usually from a domestic water source, along two paths for a dual purpose: along a first path into an hydraulic cylinder to drive a piston that forces a highly concentrated liquid chemical out of the cylinder into a mixing area, and along a second path to the mixing area where the water mixes with the chemical to achieve a mixture having a lesser, desired concentration of the chemical. The mixture then is ejected from the mixing area to an outlet connected by a hose to a spray nozzle. The Lübbecke U.S. Pat. No. 716,910 for spraying disinfectants; to Whittaker U.S. Pat. No. 1,297,622 for spraying plants; and to Wilkinson U.S. Pat. No. 1,578,944 for repairing walls with plastic material, are examples of such dual automatic mixing and spraying equipment.

Since spraying equipment of the type disclosed in the above-identified patents may be relatively lightweight, it can be carried about to the places of use and, to that extent, is portable. Portability of the kind disclosed in the Baker U.S. Pat. No. 1,169,524, however, is not provided in the automatic mixing and spraying equipment of these patents. Baker on the other hand does not have automatic mixing. The Swett U.S. Pat. No. 1,831,979 also discloses portability but requires a type of wheel barrow and uses a more complex mixer.

Although such equipment may be used to spray many materials, a specific application is to spray a solution that will remove mildew from walls. Mildew must of course be removed before walls are painted and is a common problem in moist and or humid climates. For such an application, portability and handling convenience of the spray equipment are essential. Moreover, for greater productivity, the equipment must mix the liquid ingredients automatically as it sprays the mixture. In addition, the concentration of the mixture must be capable of quick and easy adjustment from time-to-time on the job, since the particular mixture may need to be changed, as the tenacity of the mildew requires. As with any equipment, simplicity and economy of manufacture are also important objectives.

Many painters have used a simple garden sprayer to remove mildew. These devices include a container containing a pre-mixed spray solution, usually bleach, that is pressurized by a hand-operated plunger and dispensed through a wand. Though portable and uncomplicated, these sprayers have several limitations, inter alia, manual versus automatic mixing and an inability to change the proportions of the liquids in the mixture quickly at the jobsite. The expected concentration is poured into the equipment before starting. If on the job it proves less than an optimal mix, the work must be stopped to change the concentration by adding solution or water to the container. If any of the equipment disclosed in the above-identified patents were to be used, it would lack the optimal combination of portability, handling convenience, automatic mixing, mixture adjustment, servicing ease, and/or manufacturing economy and simplicity.

SUMMARY

A portable mixing and dispensing apparatus, especially useful for dispensing by spraying, is provided that includes an hydraulic unit and a fluid conducting, mixing and supporting framework. The framework includes spaced end plates and a conduit assembly. Each end plate has a cylinder head portion forming part of the cylinder of the hydraulic unit, an upper mounting flange, and a lower flange. The conduit assembly includes an intermediate conduit/handle and a pair of end units. The end units are nearly identical and are secured to the end plates so as to constitute unitary structures therewith, releasably connected to opposite ends of the cylinder body of the hydraulic unit and to the intermediate conduit/handle, thereby enabling easy access to the cylinder body and piston in the body. Each end unit includes an outlet conduit and an end conduit. The end conduits extend through the upper flanges and slip into the conduit/handle in a sealed, fluid conducting connection, thereby also releasably mounting the conduit/handle on the end plates. One of the end conduits is capped and serves as an auxiliary supporting leg, and two other legs extend from the same end plate, the three legs supporting the apparatus during filling. An outlet fitting is connected to the other end conduit, and an outlet hose may be connected to the outlet fitting and wrapped around the upper flanges in notches thereof. The lower flanges serve as main supporting legs during use of the apparatus for spraying. A method is also provided for rapidly filling the apparatus with a spraying liquid.

An object of the present invention is to provide an improved portable mixing and apparatus especially useful for dispensing by spraying.

Another object is to provide a fluid conducting, mixing, and supporting framework that facilitates supporting, handling, servicing, and storing a portable mixing and spraying apparatus and particularly the hydraulic unit of the apparatus.

A further object is to simplify the construction of a portable mixing and spraying apparatus for ease and economy of manufacture and use.

An additional object is to provide duplicate parts that provide a symmetrical, simplified construction of a portable mixing and spraying apparatus, that minimize manufacturing costs, and that facilitate use.

A still further object is to provide parts of a portable mixing and spraying apparatus that have the multiple functions of conducting the fluids being mixed and of supporting and handling the apparatus.

Yet another object is to facilitate the disassembly of a portable mixing and spraying apparatus to enable ready access to the parts needing maintenance.

A further object is to provide an apparatus as otherwise described that is self-cleaning.

A still further object is to provide such an apparatus in which the possibility of failure is minimized.

An additional object is to provide an apparatus as described that allows static pressure to be quickly and safely relieved prior to filling.

A further object is to provide a method for quickly and safely, and thus facilitating, filling a mixing and spraying apparatus.

Still another object is to facilitate the retention of an outlet hose on a portable mixing and spraying apparatus for ease of use and storage.

An additional object is provide a compact and durable portable mixing and spraying apparatus having sufficient capacity for performing its intended spraying tasks without undue interruption for refilling and yet is sufficiently light-weight to be carried by one person even when filled with the solution to be sprayed.

Another object is to prevent vapor lock while filling a portable mixing and spraying apparatus.

These and other objects, features and advantages of the present invention will become apparent upon reference to the following description, accompanying drawings, and appended claims.

DETAILED DESCRIPTION

Figure 7:
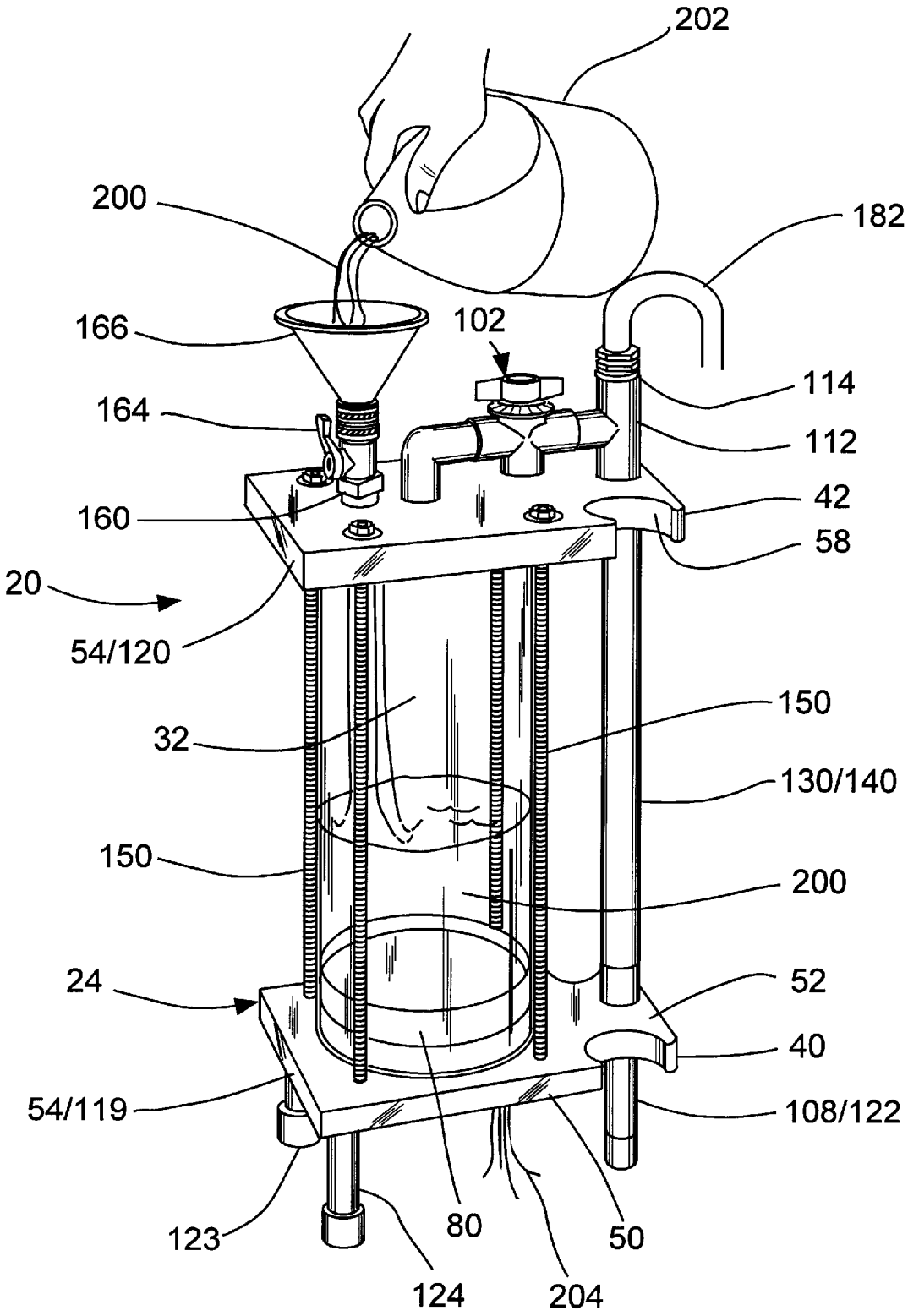
FIG. 7 is a perspective view of the apparatus on the scale of FIGS. 1 and 2 standing on end and being filled with a concentrated solution to be mixed and sprayed by the subject apparatus but showing only a fragment of an outlet hose
Figure 8:
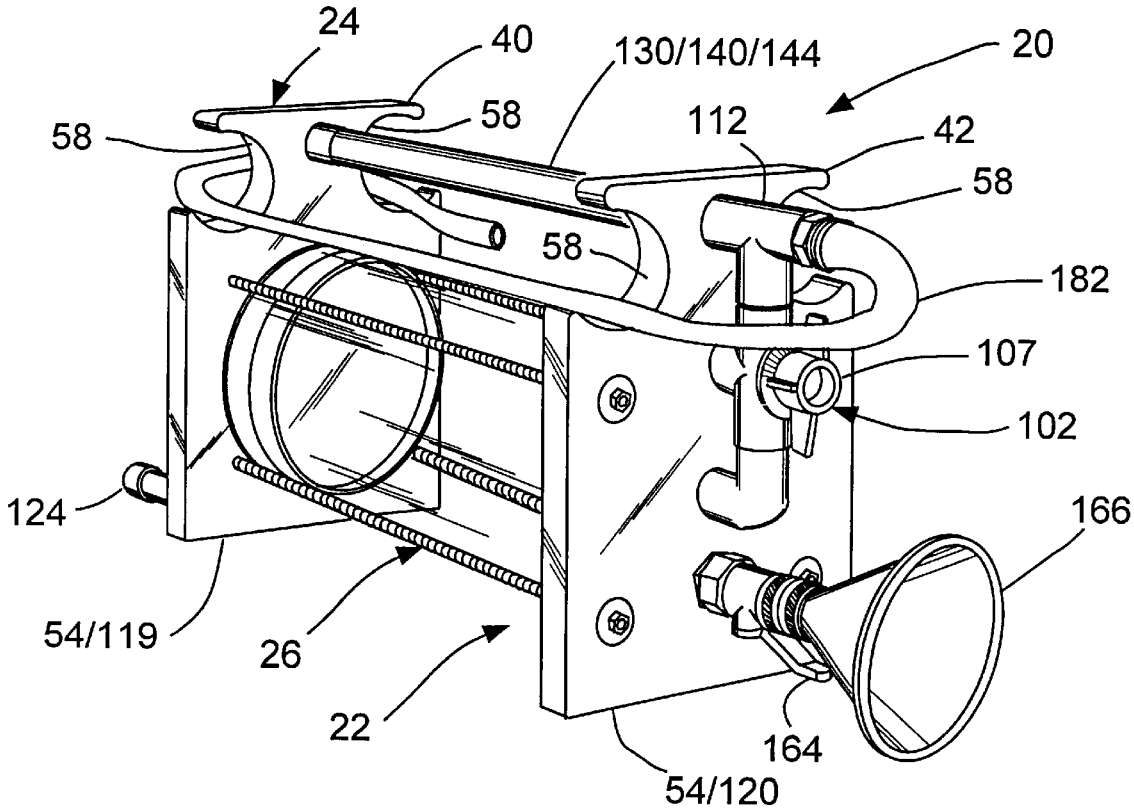
FIG. 8 is a somewhat reduced perspective view similar to FIG. 5 but showing a fragment of the outlet hose attached to the outlet coupling and partially wrapped around the upper flanges of the end plates of the subject framework, it being understood that the opposite end of the outlet hose may be connected to a spraying wand with nozzle or other outlet appliance, not shown.
Figure 9:
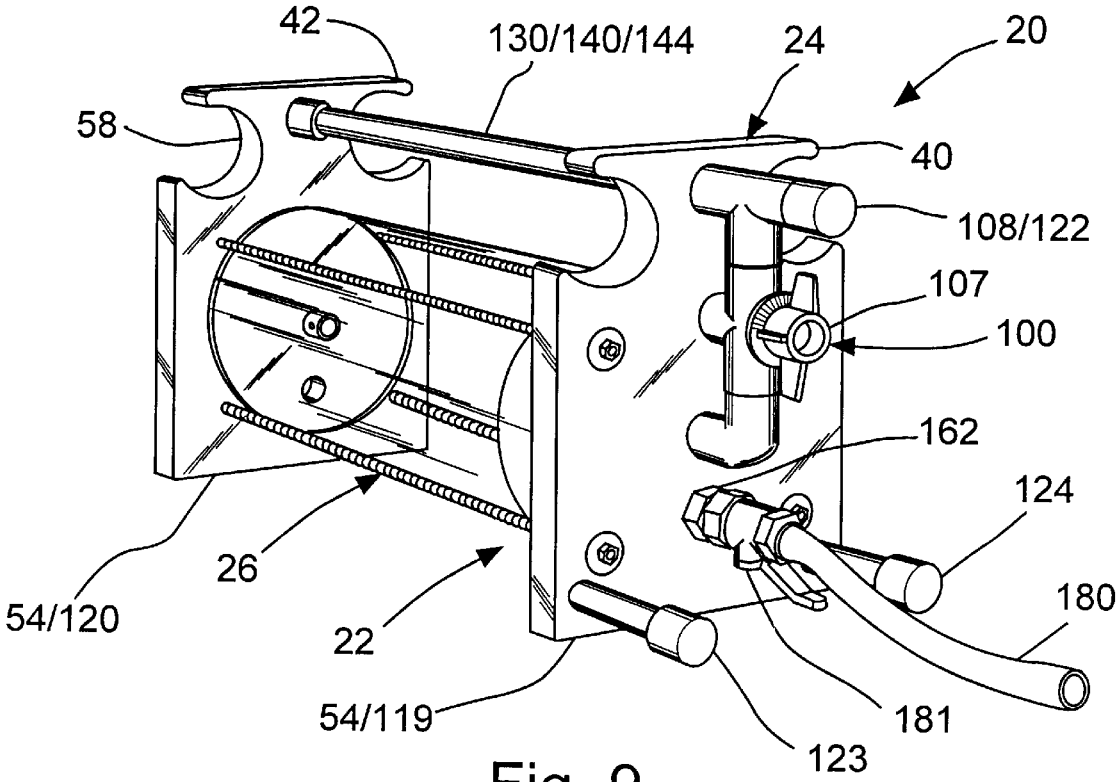
FIG. 9 is a somewhat reduced perspective view similar to FIG. 6 but showing a fragment of an inlet hose attached to the inlet coupling, it being understood that the opposite end of the inlet hose may be connected to a source of water under pressure, such as a domestic hose bib, not shown.

An embodiment of the subject portable mixing and spraying apparatus is generally identified in the drawings by the number 20. The apparatus 20 (FIG. 4) includes an hydraulic unit 22 and a fluid conducting and supporting framework 24 releasably interconnected by fasteners 26. The hydraulic unit 22 includes a cylinder 30 (FIGS. 1–4) having an elongated, horizontally extending, transparent cylinder body 32 with a first end 34 and a second end 36. Reference to "horizontal" here relates to the normal orientation of the cylinder body when the apparatus is being employed for spraying (FIGS. 1 and 2), although as will be subsequently described, the apparatus also has a filling orientation (FIG. 7) wherein the cylinder body is upstanding or vertical. Similar terms of reference to this normal horizontal spraying orientation will be used throughout the description but are to be understood to be for descriptive convenience only and not a limitation on the position of this portable apparatus.

The cylinder body 32 (FIGS. 1 and 2) is made of a hard, corrosion-resistant, fluid-impervious material, preferably plastic, and preferably the thermoplastic resin PVC. The cylinder body is also preferably approximately ¼" inch thick, approximately 16½ inches long by approximately 6¾ inches in outside diameter. Although certain dimensions are provided throughout this specification by way of example, it is to be understood that the invention is not limited to any particular dimensions. Still, for durability, for convenience of use in spraying, and for handling by a single person, the dimensions given have proven quite satisfactory.

The fluid conducting and supporting framework 24 (FIGS. 1–4) includes identical first and second upstanding end plates 40 and 42 (FIGS. 3*a* and 3*b*), also of a hard, corrosion-resistant fluid-impervious material, preferably plastic such as PVC, and are releasably fastened by the fasteners 26 in fluid-tight relation at opposite ends 34 and 36, respectively, of the cylinder body 32 and in spaced parallel relation to each other. Although identical, the end plates are referred to as "first" and "second" and by different reference numbers to facilitate description of the different functions that occur at opposite ends of the apparatus 20.

Each end plate 40 and 42 (FIGS. 3*a* and 3*b*) may be thought of as having three portions or sections, namely, a central cylinder head 50, an upper flange 52, and a lower flange 54. The cylinder head and lower flange portions of each end plate are of generally rectangular shape, whereas the upper flange of each plate is of generally I-shape and provides a pair of lateral notches 58 and 60 and a central hole 62. There are no lines defining the exact areas of each cylinder head or its upper or lower flanges, the cylinder heads being of a height and width greater than the outside diameter of the cylinder body 32, and the upper and lower flanges projecting radially outwardly, i.e., respectively upwardly and downwardly in the normal operating position as above described, from their cylinder heads and the cylinder body. In the preferred dimensional relationships, each end plate may be about 1 inch in thickness and approximately 8 inches wide by about 11½ inches high overall; each upper flange may extend upwardly about 3¾ inches from the cylinder head; and each lower flange may extend downwardly from the cylinder head by about 1¼ inches.

Each cylinder head 50 (FIGS. 4–6) has an upper outlet port 70 extending therethrough that is concentric to and in fluid communication with the cylinder body 32 when the end plates 40 and 42 are fastened at opposite ends 34 and 36 of the cylinder body as above described. Each cylinder head also has a lower inlet port 72 therethrough that is eccentric to and in fluid communication with the cylinder body spaced slightly below the outlet port and preferably in vertical alignment therewith.

The hydraulic unit 22 also includes a piston or plunger 80 (FIGS. 1, 4 and 5) fitted within the cylinder body 32 for slideable reciprocal movement back and forth between the cylinder heads 50 in a manner to be described. The piston is made of a durable, corrosion-resistant material, such as rubber and particularly Vicon rubber, and has an outer diameter approximately equal to the inside diameter of the cylinder body and, in the example for which dimensions are given above, an axial length of about 2 inches. The piston includes a somewhat axially flexible, central radial web 82 and first and second annular flanges 84 sealingly, slidingly engaging the inside peripheral surface of the cylinder body and respectively extending axially endwardly in opposite directions from the central web toward the cylinder heads 50 of the first and second end plates 40 and 42. In a manner to be described, the piston moves fore and aft in the cylinder body respectively in a compression stroke moving toward the second end plate 42 and in a retraction stroke moving toward the first end plate 40.

A snorkling nipple 88 (FIGS. 1, 4 and 6) that is rigid and perforated projects inwardly from the second end plate 42 in axial alignment and fluid communication with the outlet port 70 in the cylinder head 50 of the second end plate. The outlet nipple has an axial length that is less than the axial length of each annular flange 84 of the piston 80 and also has a pair of apertures 90 extending therethrough on opposite sides of the nipple. In the fully compressed stroke of the piston, that is when the second annular flange engages the cylinder head of the second end plate, the web of the piston flexes forwardly and engages the nipple. The apertures 90 prevent the web from blocking the outlet port 70, as may be visualized in FIGS. 4 and 6, so that the cylinder 30 is allowed to breathe through the apertures even when the piston is in its fully compressed position.

The fluid conducting and supporting framework 24 (FIGS. 1, 3*a*, 3*b*, and 4–6) also includes first and second end fluid coupling units 100 and 102 of corrosion-resistant material, such as PVC plastic. These end coupling units are nearly identical, and for the most part, the same reference numbers will be used for common parts, and only the different parts will be given different reference numerals. Thus, referring especially to FIG. 6, the first end coupling unit 100 includes an L-shaped outlet conduit 106 and a straight end conduit 108. The outlet conduit has a lower horizontal leg that is connected, preferably by gluing, to the cylinder head 50 of the first end plate 40 in fluid communication with the outlet port 70. The outlet conduit has a vertical leg that extends vertically upwardly in spaced relation to and opposite from the upper flange 52 of its adjacent first end plate. A volume control or mixing valve 107 is located in and considered part of the outlet conduit and is adjustable to control the volume of liquid passing through the end coupling unit. The vertical leg of the outlet conduit connects in a T-shaped junction to its end conduit between its opposite ends. The length of the vertical leg locates the end conduit opposite to its adjacent upper flange in alignment with the adjacent hole 62 in the flange. The inner end of the end conduit has a neck 109 of reduced diameter that extends through this hole and is connected, preferably by gluing, to the flange. The neck also projects inwardly of the flange by a short distance, about ⅞ inch, in accordance with the preferred dimension being given herein, and for a purpose to be described.

Figure 1:
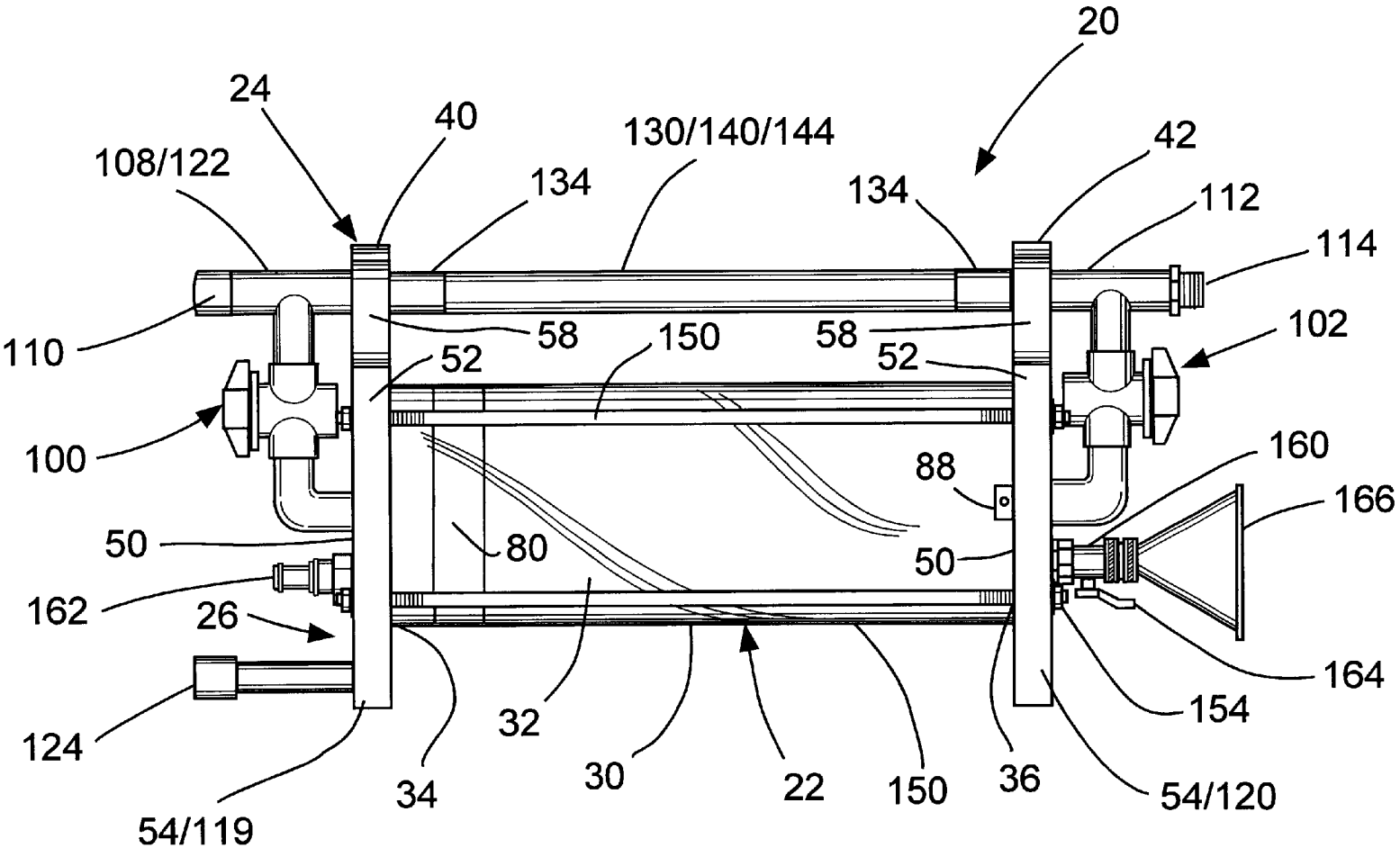
FIG. 1 is a side elevation of an embodiment of a mixing and spraying apparatus constructed in accordance with the principles of the present invention.
Figure 2:
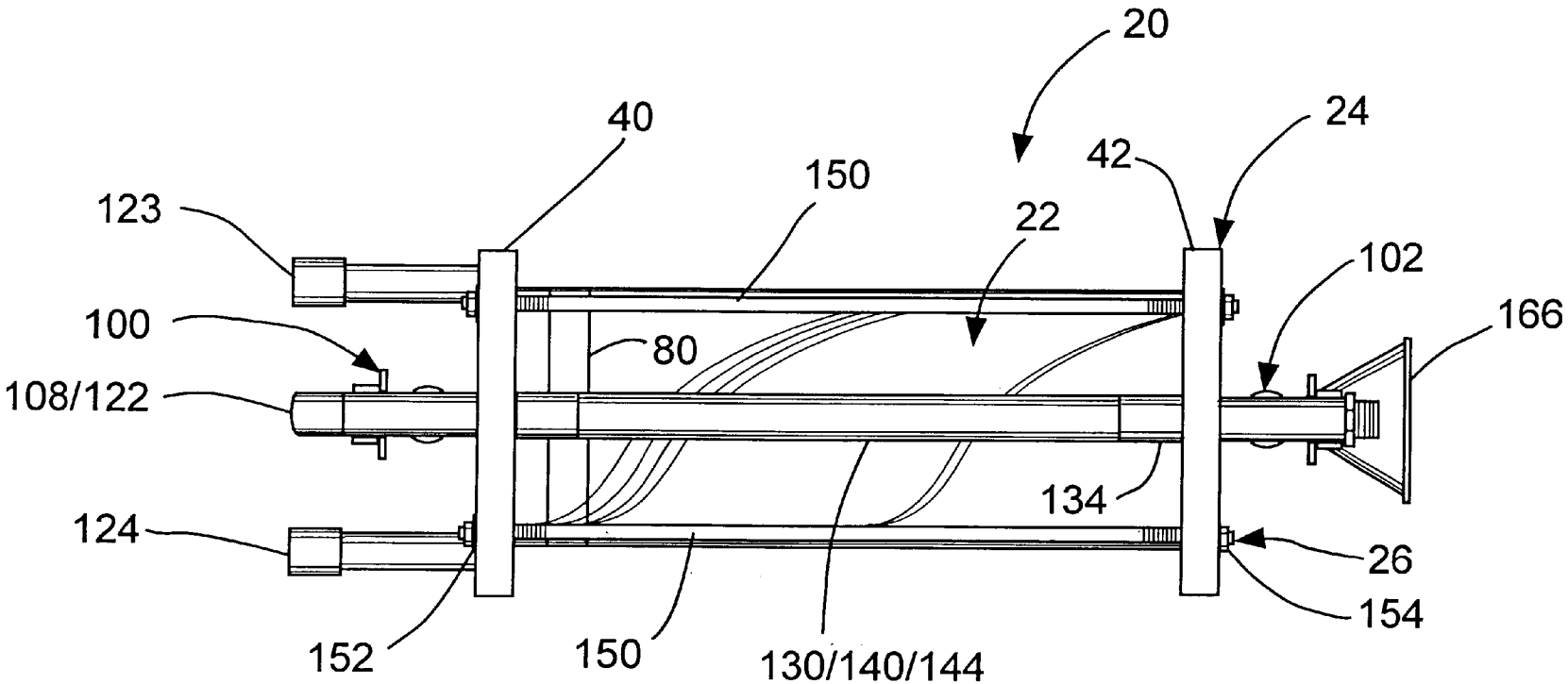
FIG. 2 is a top plan view of the apparatus shown in FIG. 1.
Figure 3A:
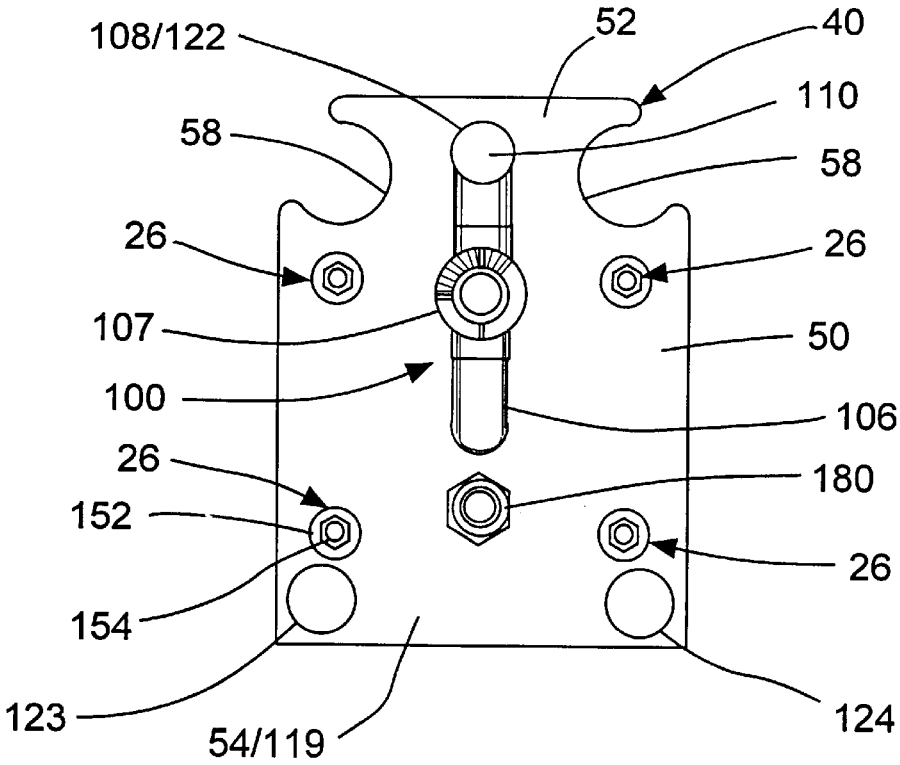
FIG. 3*a* is a somewhat enlarged end elevation of the end of the apparatus as viewed from the left end of FIGS. 1 and 2.
Figure 3B:
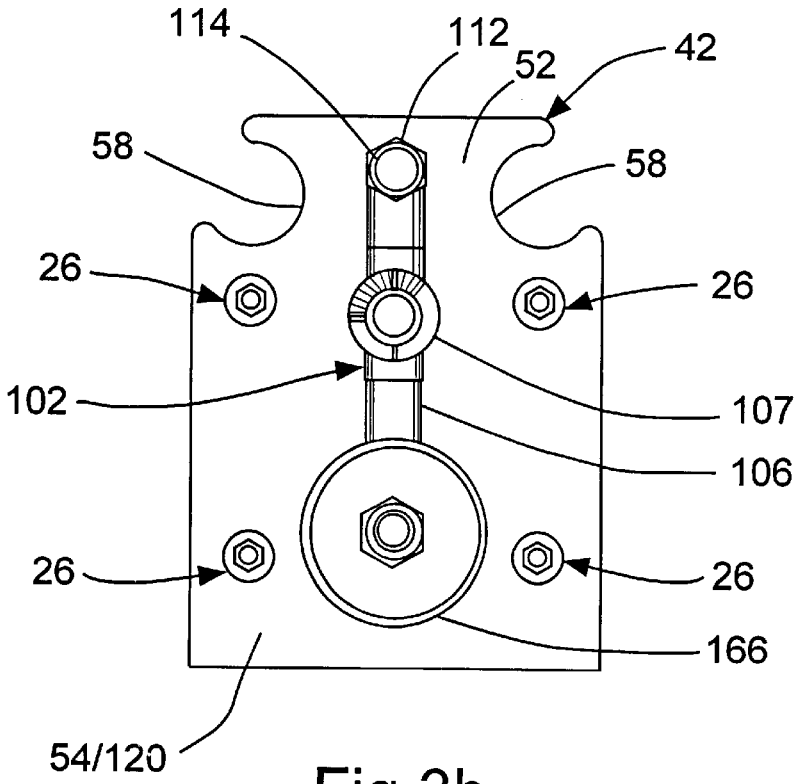
FIG. 3*b* is a somewhat enlarged end elevation of the apparatus as viewed from the right end of FIGS. 1 and 2.

The first end coupling unit 100 (FIGS. 1 and 6) also includes a cap 110 on its end conduit 108 at the opposite end from the neck 109, so that the length of the end conduit and the cap together extend outwardly from its respective first end plate 40 slightly beyond the mixing valve 107, as best seen in FIG. 1. As such, the end conduit 108, including its cap 110, performs the dual function of a first auxiliary supporting leg 122 and a fluid conducting member.

As above indicated, the second end coupling unit 102 (FIGS. 1 and 5) and its connection to the second end plate 42 are identical to the first coupling unit 100 except for a threaded outlet fitting 114 on the end conduit 112, instead of a cap as 120. The end conduit 112 has a neck 113 identical to the neck 109 of the end conduit 109. At this second end of the apparatus 20, the end conduit 112 serves the dual function of a mixing chamber and an outlet for the mixture of liquids to be sprayed, as will be seen.

Furthermore, the fluid conducting and supporting framework 24 (FIGS. 1, 2, 5 and 6) includes an elongated intermediate conduit 130, also of corrosion-resistant material such as PVC, extending between the upper flanges 52 of the end plates 40 and 42 in substantially parallel relation to the cylinder body 32 and in alignment with the holes 62 in the flanges. Sleeves 134 are fitted over the opposite ends of the conduit 130 and are closely adjacent to the holes in the end plates. As may be visualized from FIG. 4, the sleeves slideably receive the necks 109 and 113 of the first and second end conduits 108 and 112, respectively, so that the sleeves substantially abut their associated end plate. O-rings 136 circumscribe the necks of the end conduits between these necks and the sleeves, thereby providing a sealed, slip fit between each end of the intermediate conduit and its associated neck.

It will be understood, therefore, that the fluid conducting and supporting framework 24 (FIGS. 1, 2, 5 and 6) has two general functions, first, fluid conducting, and second, apparatus supporting. First, liquid within the cylinder body 32 exits the cylinder body into and through the end coupling units 100 and 102. Liquid passing through the first end coupling unit 100 enters the intermediate conduit 130 from the end conduit 108 and travels to the end conduit 112 of the second end coupling unit 102. Liquid also exits the cylinder body into and through the second end coupling unit 102, travels upwardly through the outlet conduit 106 of the second end coupling unit, and mixes in its associated end conduit 112 with the liquid entering this end conduit from the intermediate conduit. The mixed liquids then exit through the outlet fitting 114. The volumes of liquids passing through the end coupling units are adjusted by the valves 107, so that the valves thereby control the mixture of the liquids exiting from the outlet fitting 114.

The fluid conducting and supporting framework 24 (FIGS. 1, 2, 5 and 6) also has a second function in providing support for the cylinder body 32 or more generally the hydraulic unit 22. In this regard, the intermediate conduit 130 also functions as a handle 140 whereby the apparatus 20 can be easily carried and moved from one location to another. To strengthen and enhance this handle function, a rigid tube 144, preferably of stainless steel, is slid over the intermediate conduit between the sleeves 134 with a relatively close fit on the conduit as well as between the sleeves. The tube avoids bending of the conduit when the apparatus is lifted with the handle especially when filled with liquid. Further, the lower flanges 54 function as main supporting legs 119 and 120 for supporting the apparatus in its normally horizontal position when used for spraying. Still further, the framework also includes second and third auxiliary legs 123 and 124 that project endwardly from the lower flange 54 of the first end plate 40 relatively adjacent to the side edges of this end plate. The second and third legs are of the same length as the length of the first auxiliary leg 122, which, in the example of dimensions given, is approximately four inches from the first end plate. Moreover, as will be seen in the drawings, the second and third auxilarly legs are in a triangular relationship with the first auxilarly leg.

The fasteners 26 (FIGS. 1–6) that releasably connect the fluid conducting and supporting framework 24 to the cylinder body 32 include elongated threaded fastener rods 150, preferably four in number, having opposite ends that extend through holes in the end plates 40 and 42 in substantially equidistantly peripherally spaced relation about the cylinder body 32, essentially outlining the cylinder head 50 portions of the end plates 40 and 42. Washers 152 are placed on the ends of the rods that extend through the end plates, and nuts 154 are threaded on the rods and tightened against the washers. With the cylinder heads against the opposite ends 34 and 36 of the cylinder body and the sleeves 134 on the intermediate conduit/handle aligned with the necks 109 and 113, tightening the nuts draws the cylinder heads into fluid-tight relation with the cylinder body and the necks into slideable sealing relation in the sleeves. Gaskets 156 are interposed the opposite ends of the cylinder body and the cylinder heads to insure a fluid-tight connection in the cylinder 30. The O-rings 136 insure fluid-tight connections between the conduit/handle and the end units 100 and 102.

Figure 5:
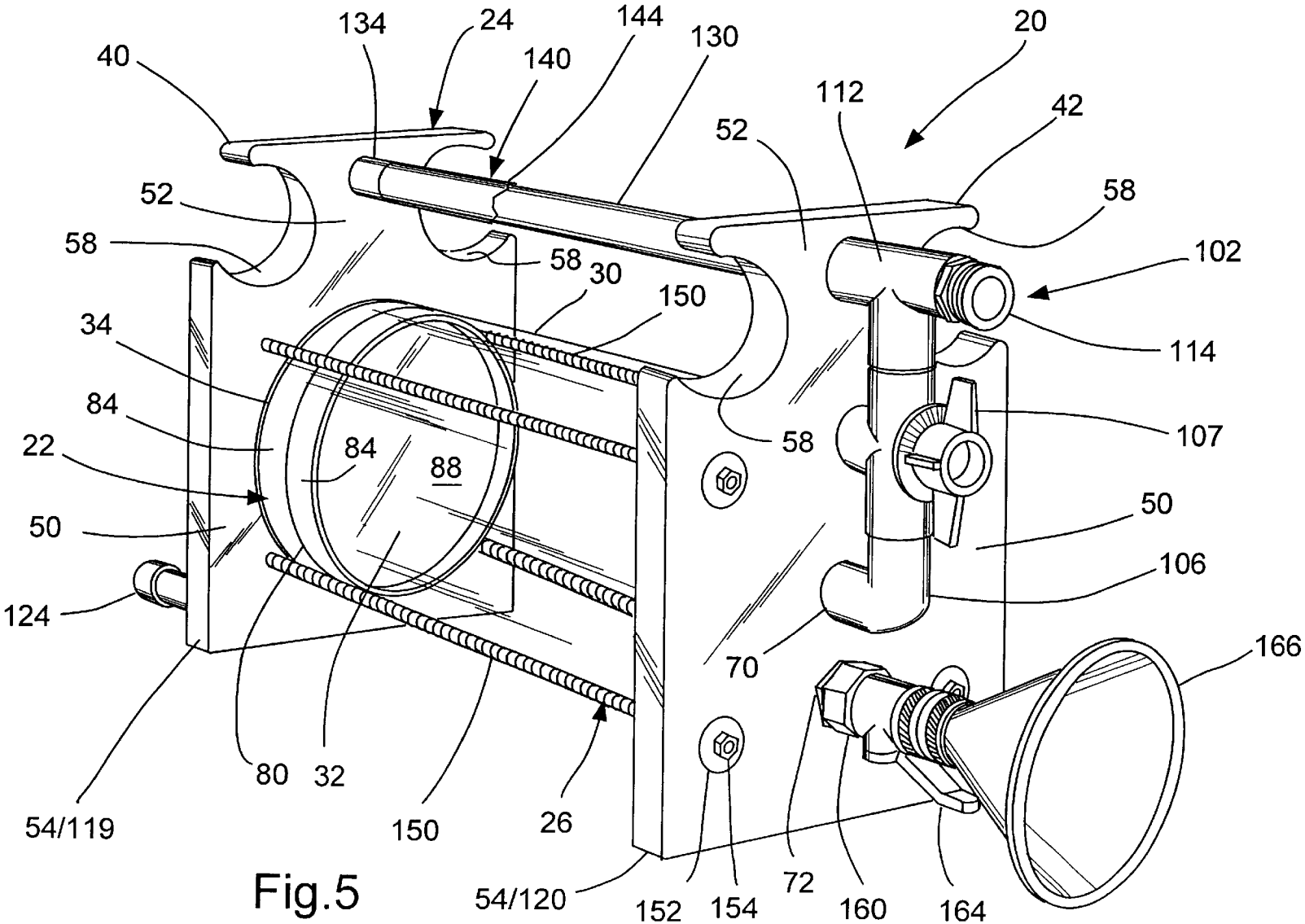
FIG. 5 is an enlarged perspective view of the subject apparatus as viewed from the right front corner of FIGS. 1 and 2.
Figure 6:
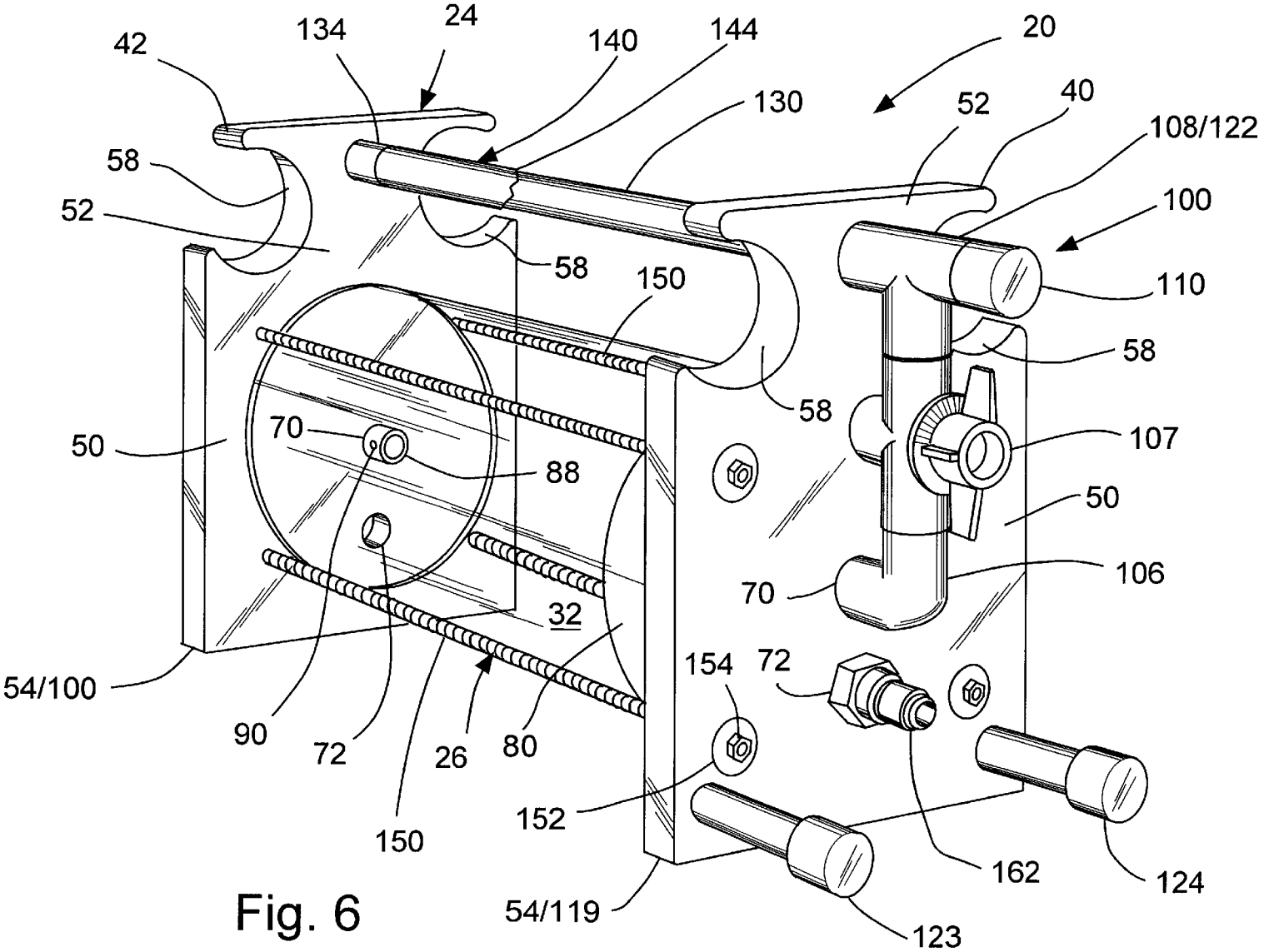
FIG. 6 is an enlarged perspective view of the subject apparatus as viewed when the apparatus is turned around by one hundred eighty degrees from the view in FIG. 5.

The subject spraying apparatus 20 (FIGS. 1, 2, 5 and 6) also includes an inlet fitting 160 connected to the inlet port 72 of the cylinder head 50 in the second end plate 42 so that this inlet fitting is in fluid communication with the cylinder body 32. An on-off filling valve 164 is attached to this inlet fitting, and a funnel 166 is connected to the valve. A quick-connect inlet fitting or coupling 162 is attached to the inlet port 72 in the cylinder head of the first end plate 40, as best seen in FIG. 6. In using the subject apparatus 20, an inlet hose 180 with an on-off valve 181 for conducting liquid under pressure to the cylinder 22 is attached to the inlet fitting 162. An outlet hose 182 has one end attached to the outlet fitting 114 and an opposite end that may be attached to a spray or applicator wand or other dispensing device, not shown, terminating in a nozzle or other opened/closed outlet for convenience in spraying the mixture emanating from the subject apparatus 20.

DESCRIPTION OF THE METHOD AND OPERATION OF THE APPARATUS

In order to use the apparatus 20 (FIGS. 5, 6, 8 and 9) for spraying, it must of course be filled with a desired spraying solution 200, and the subject invention provides a method for doing so rapidly and safely. In describing the filling method, it is assumed that the apparatus has been in use for spraying but is now out of solution. As such, the cylinder 30 is essentially empty on the forward side of the piston 80, and the piston is in its extreme compression stroke against the cylinder head 50 of the end plate 42. Also, the apparatus will still be in its normal condition of use for spraying, namely, in a horizontal position; with the filling valve 164 closed, the mixing valves 107 open; the inlet hose 180 connecting the inlet fitting 162 to a source of water under pressure, such as a domestic hose bib, not shown; and the inlet valve 181 open thereby admitting water to the cylinder and applying pressure to the piston, forcing it into its extreme compression stroke. The applicator wand, not shown, is also connected to the outlet hose 182 and the spray nozzle, not shown, on the wand is closed.

As a first step in refilling (FIGS. 5, 6, 8 and 9), and while the apparatus 20 is still in a horizontal position and otherwise as described in the preceding paragraph, the inlet valve 181 is closed to shut off the inflow of water into the cylinder 30. The filling valve 164 is then opened thereby to relieve all static pressure in the system. Such static pressure could also be relieved by opening the nozzle, not shown, on the spray wand, not shown. Opening the filling valve, however, relieves this static pressure completely and quickly, as well as safely since the funnel 166 serves to deflect escaping liquid and air and direct it only endwardly and horizontally of the apparatus. The inlet hose 180 and valve 181 are next disconnected via the quick-disconnect fitting 162 which is thereby opened, and the mixing valves 107 are closed. The inlet hose is disconnected safely since the static pressure has been previously relieved, as described.

The apparatus 20 (FIG. 7) is then stood on end with the auxiliary supporting legs or tripod 122, 123 and 124 resting on a level surface and with the funnel 166 directed upwardly in a vertical position. Any water 204 remaining under or back of the piston 80 is thus allowed to drain downwardly out of the cylinder 30 through the now open inlet fitting 162 onto the ground, creating a partial vacuum above the piston. While this draining is ongoing, spraying solution 200, such as liquid bleach for mildew treatment or other relatively concentrated liquid to be mixed and sprayed, is poured into the funnel 166. The spraying solution is sucked into the cylinder so quickly by the reduced pressure in front of the piston that two containers, one of which is shown at 202, can be simultaneously emptied into the funnel without any spillage of solution. Release of water under the piston and the weight of solution on top of the piston causes the piston to slide along the inside periphery of the cylinder body 32 and gravitate to the cylinder head 50 in the first end plate 40 at the extreme position of its retraction stroke. It will be understood that the piston is in peripheral sealing engagement with the cylinder body 32 so that neither water 204 nor the solution 200 leaks past the piston. Accordingly, the cylinder is rapidly filled with the solution, whereupon the valve 164 is closed and the apparatus 20 is returned to its horizontal position with its main supporting legs 119 and 120 resting on a level surface, as shown in FIGS. 1–6, 8 and 9, ready for spraying again.

Note that the filling valve 164 and the funnel 166 (FIG. 8) have both pressure relief and filling functions. For pressure relief, the valve is opened while the apparatus 20 is horizontal, and the funnel serves to direct air and water escaping from the system horizontally outwardly, as described. For filling, the valve is also opened but while the apparatus is vertical, and the funnel serves to direct or admit the incoming liquid vertically gravitationally downwardly into the cylinder 30. It is further noted that the levered valve 164 is superior to a threaded cap for the inlet fitting 160 since a cap must be threaded on and off and is thus slower to use and may be misplaced or lost.

Note also that in the filling of the cylinder 30 (FIG. 7), the piston 80 will not be held up against the cylinder head 50 of the second end plate 42 because of vapor lock, i.e., reduced air pressure above the cylinder, because of the sucking action just described. The nipple 88 maintains the web 82 of the piston in spaced relation to the second cylinder head in the extreme position of the compression stroke. Thus, the lateral apertures 90 in the nipple allow the cylinder above the piston to breathe through the second end coupling unit 102 so that the piston is allowed to descend on the falling column of water under the piston.

With the apparatus 20 (FIGS. 1–6 and 8) loaded with the solution 200, the inlet hose 180 is connected to its fitting 162 and is or remains connected to a suitable source of water, or other diluting liquid, under pressure. The outlet hose 182 need not be disconnected from the outlet fitting 114 while filling the cylinder 30 nor during storage of the apparatus and thus preferably remains connected to the outlet fitting except for changing hoses, for servicing, or the like. As above suggested, a spray wand incorporating a nozzle, not shown, may be connected to the end of the outlet hose, which may be of considerable length, such as twenty-five feet. During use of the apparatus and for storage, the outlet hose may be wrapped around the upper flanges 52 in the notches 58, as partially indicated in FIG. 8. The upper flanges thus provide a convenient way to hold and store all of the outlet hose and that portion not being used. It will be noted that with the hose wrapped around the flanges, the handle 140 is still available within the coiled hose to grasp and lift or otherwise move the apparatus from place to place.

The mixing valves 107 (FIGS. 1–6, 8 and 9) are set for the desired mix of water 204 and solution 200 in the ultimate mixture emanating from the apparatus 20 through the outlet hose 182. The inlet valve 181 is opened allowing water under pressure to enter or be delivered into the first end 34 of the cylinder 30 through the inlet hose 180 and fitting 162. The water forces the piston 80 in its compression stroke, causing the solution 200 in front of the piston to be forced through the second end coupling unit 102 into the mixing end conduit 112. Water under pressure also leaves the cylinder through the end coupling unit 100 and passes through the intermediate conduit 130 into the end conduit 112 where it mixes with the solution and then exits from the outlet fitting 114 into the outlet hose 182. If more or less water or solution is desired to change the mix, the mixing valves 107 are adjusted. To change the location of the apparatus, the user picks it up and may carry it about with the handle 140, the tube 144 preventing any bending of the conduit 130, and again set it down on the legs 119 and 120 in a new location.

Since the cylinder body 32 (FIGS. 1–6, 8 and 9) is transparent, the operator can tell when the cylinder is full or empty or otherwise determine the status of the contents. When the solution 200 in the cylinder 30 has been depleted or nearly so, and it is desired to refill the cylinder, the method described above is repeated. In this way, the cylinder can quickly be filled with solution and the spraying operating continued without significant interruption of work.

An important advantage of the subject mixing and spraying apparatus 20 is the ease of cleaning and otherwise servicing the apparatus. First, the apparatus is essentially self-cleaning in that the water follows the piston 80 and cleans the inside of the cylinder body 32 on each stroke of the piston. Water also travels through the end unit 100 and the intermediate conduit 130, flushing these parts. Water can even be directed through the end unit 102 and into the cylinder in front of the piston if the outlet fitting 114 is capped and the mixing valve 107 is opened, thereby flushing out the end unit 102.

Figure 4:
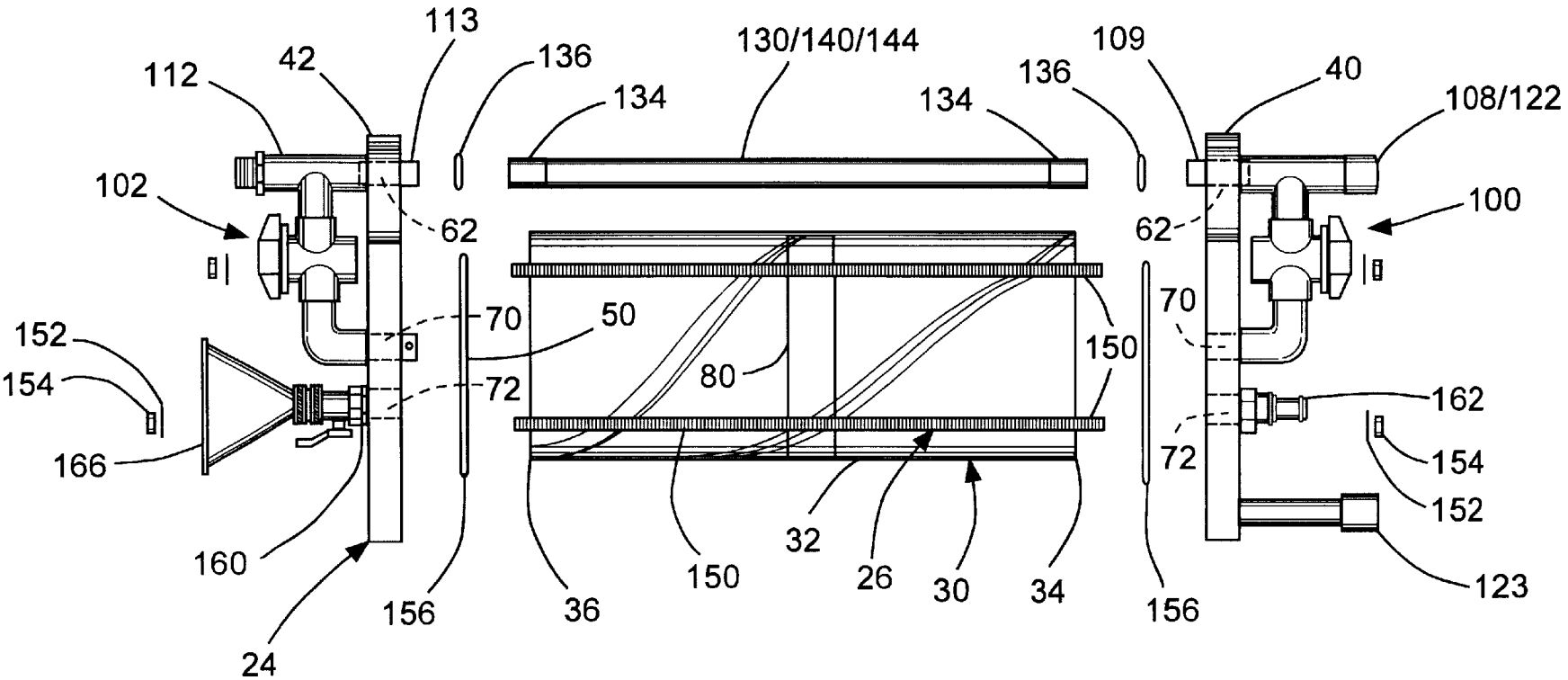
FIG. 4 is an exploded, partially disassembled, side elevation of the apparatus on the same scale as FIGS. 1 and 2, but rotated one hundred eighty degrees from FIGS. 1 and 2.

Of special significance, however and as best seen in FIG. 4, when the four fasteners 26 are removed, the first and second end plates 40 and 42 and their associated and attached first and second end coupling units 100 and 102 can be removed intact as two separate pieces from the opposite ends 34 and 36 of the cylinder body 32 and from the opposite ends 132 of the intermediate conduit 130. Thus disassembled, the piston 80 as well as the inside of the cylinder body are conveniently accessible. There may be a desire further to clean the inside of the cylinder body and/or the piston because of the solution 200 being handled. It also may be necessary to replace the piston from time-to-time because of wear on the annular flanges 84 and the need for maintaining a fluid-tight, sliding engagement between the piston and cylinder body. Also, replacement of the O-rings 136 and/or the gaskets 156 may be required, all which can be accomplished by the ready disassembly of the apparatus, as described. To facilitate this disassembly, the end plates 40 and 42 and their associated end coupling units 100 and 102 are preferably glued together, as described, so that only the four fasteners need be disconnected and connected.

Furthermore, the subject fluid conducting and supporting framework 24 enhances manufacturing of the subject apparatus 20. In other words, the first and second end plates 40 and 42 and their respective first and second end coupling units 100 and 102 are symmetrical and essentially identical, the only differences being the end cap 110 and the outlet fitting 114, the inlet fittings 160 and 162, the funnel 166, and the nipple 88. These later elements are all, of course, attachments to the end plates which are identical. Also, the outlet conduits 106, the valves 107, and the end conduits 108, 112 and necks 109, 113 (without the cap 110 or fitting 114) are also identical. These identities thus facilitate manufacture including interchangeability of parts.

Although a preferred embodiment of the present invention has been shown and described, various modifications, substitutions and equivalents may exist without departing from the spirit and scope of the invention. Accordingly, it is to be understood that the present invention has been described by way of illustration and not limitation.

What is claimed is:

1. A portable spraying apparatus, comprising:

a cylinder body having opposite first and second ends and having a longitudinal axis;

a piston in the body movable between its opposite ends; and a fluid-conducting framework including spaced first and second end plates disposed transversely of said axis and a conduit assembly, the end plates providing cylinder heads secured in substantially parallel relation to each other at the first and second ends respectively of the body, each cylinder head having a fluid outlet and a fluid inlet both in fluid communication with the cylinder body, the end plates also having horizontal supporting legs extending transversely of said axis outwardly from the cylinder body for supporting the apparatus in a horizontal position, the conduit assembly having first and second inlet branches at opposite ends of the cylinder body and respectively connected in fluid communication to the fluid outlets of the heads, an intermediate branch, and first and second end branches respectively extending endwardly from the end plates axially of the cylinder body and in fluid communication with the intermediate branch and with their respective first and second inlet branches, wherein the first end branch is a first vertical supporting leg; and wherein there are second and third supporting legs extending endwardly from the first end plate in triangular relation to the first vertical supporting leg, whereby the vertical supporting legs are for supporting the apparatus in a vertical position.

2. The apparatus of claim 1, wherein a funnel is attached to the fluid inlet of the second end plate and has an axis parallel to the vertical supporting legs.

3. The apparatus of claim 2, wherein a valve is connected between the funnel and the fluid inlet to which is attached.

4. A portable apparatus for mixing and in dispensing fluid materials, comprising:

a cylinder body having opposite first and second ends, a longitudinal axis, and being movable between a horizontal operating position and a vertical filling position;

a piston in the body movable between its opposite ends;

cylinder heads secured in substantially parallel relation to each other at the first and second ends respectively of the body, each cylinder head having a fluid outlet and a fluid inlet both in fluid communication with the cylinder body;

a mixing chamber mounted on and outside of the cylinder body, each of the fluid outlets being in fluid communication with the mixing chamber;

an inlet fluid conductor connected to the fluid inlet in one of the cylinder heads; and a funnel attached to the fluid inlet in the other cylinder head and having an axis parallel to the axis of the cylinder body.

5. The apparatus of claim 4, wherein there are valves connected between the fluid outlets and the mixing chamber.

6. A portable apparatus for mixing and in spraying fluid materials, comprising:

a cylinder body having opposite first and second ends;

a piston in the body movable between its opposite ends;

a fluid-conducting framework including spaced first and second end plates and a conduit assembly, the end plates providing cylinder heads secured in substantially parallel relation to each other at the first and second ends respectively of the body, each cylinder head having a fluid outlet and a fluid inlet both in fluid communication with the cylinder body, the conduit assembly having first and second inlet branches at opposite ends of the cylinder body and respectively connected in fluid communication to the fluid outlets of the heads, an intermediate branch extending between the end plates and having opposite ends mounted on the end plates, first and second end branches extending endwardly from the end plates in fluid communication with the opposite ends of the intermediate branch and with their respective first and second inlet branches, wherein the first and second end branches are releasably slidably sealingly coupled to the opposite ends of the intermediate branch through the end plates;

wherein each adjacent inlet branch and end branch are unitarily connected to the end plate at their respective ends of the cylinder body; and wherein fasteners releasably interconnect the cylinder heads and draw them into fluid-tight engagement with the cylinder body.

7. A portable apparatus for mixing first and second fluids and releasing the mixture under pressure, comprising:

a cylinder having a cylinder body and opposite first and second radial cylinder heads, the first cylinder head having a first fluid inlet and a first fluid outlet, the second cylinder head having a second fluid inlet and a second fluid outlet, the cylinder being adapted to receive the first fluid pressurized through the first inlet and the second fluid unpressurized through the second inlet;

a piston in the cylinder being movable toward the second cylinder head under pressure of the first fluid thereby to place the second fluid under pressure and force it from the second outlet, the pressurized first fluid being also thereby forced out of the first outlet;

a conduit assembly having an intermediate portion extending alongside the cylinder body, the intermediate portion having opposite ends, the conduit assembly also having opposite first and second end portions extending endwardly from the opposite ends of the intermediate portion and opposite first and second inlet portions respectively interconnecting the first and second end portions and the first and second fluid outlets and establishing fluid communication therebetween, the pressurized first fluid being conducted from the cylinder through the first inlet portion, the first end portion, and the intermediate portion to the second end portion, the pressurized second fluid being conducted from the cylinder through the second fluid inlet portion to the second end portion wherein the first and second fluids are mixed, the first end portion constituting a first supporting leg and the second end portion constituting an outlet from the apparatus for the mixture; and second and third supporting legs extending from the first cylinder head in triangular relation with the first leg.

8. The apparatus of claim 7, wherein a funnel is attached to the second fluid inlet.

9. The apparatus of claim 7, wherein each cylinder head has a radial flange projecting therefrom;

wherein the first end portion, the first inlet portion, and the first cylinder head and its radial flange are secured together as a first unit of a supporting framework for the cylinder body;

wherein the second end portion, the second inlet portion, and the second cylinder head and its radial flange are secured together as a second unit of the supporting framework; and wherein said first and second units are releasably sealingly connected in fluid communication to the cylinder body and to the intermediate portion of the conduit system.

10. The mixing apparatus of claim 9, wherein the first and second end portions are releasably slideably sealingly coupled to the opposite ends of the intermediate portion through the flanges of the cylinder heads.

11. The mixing apparatus of claim 10, wherein the cylinder heads are releasably sealed to the cylinder body; and wherein fastening rods releasably interconnect the cylinder heads and flanges and draw the heads into fluid-tight engagement with the cylinder body and the end portion into sealing coupled relation to the intermediate portion.

12. The mixing apparatus of claim 9, wherein mixing valves are located in the inlet portions.

13. The mixing apparatus of claim 12, wherein each cylinder head has laterally open notches therein, and wherein the corresponding notches are aligned longitudinally of the cylinder.

14. A portable spraying apparatus, comprising:

a cylinder body having opposite first and second ends, opposite sides, and a longitudinal axis;

a piston in the body movable between its opposite ends; and a fluid-conducting framework including spaced first and second end plates disposed transversely of said axis and a conduit assembly, the end plates providing cylinder heads secured it substantially parallel relation to each other at the first and second ends respectively of the body, each cylinder head having a fluid outlet and a fluid inlet both in fluid communication with the cylinder body, the end plates also having flanges extending transversely of said axis outwardly from the cylinder body, the conduit assembly having first and second inlet branches at opposite ends of the cylinder body and respectively connected in fluid communication to the fluid outlets of the heads, an intermediate branch having opposite end portions attached to the flanges, and first and second end branches in fluid communication with the intermediate branch and with their respective first and second inlet branches, wherein each flange has notches therein that open laterally outwardly of the cylinder body and in opposite directions therefrom, there being a pair of notches on each side of the cylinder body;

wherein the notches on each side of the body are aligned longitudinally of the body; and wherein a hose is fitted in the notches and wrapped around the flanges.

15. The apparatus of claim 14, wherein the hose is in fluid communication with the conduit assembly.

16. A portable apparatus for use in mixing and spraying a mixture of fluid materials, comprising:

a cylinder body having opposite open ends;

a piston in the cylinder body;

end plates including cylinder heads releasably sealingly closing the opposite ends of the cylinder body, each head having an inlet and an outlet port therein communicating with the body;

fasteners extending between and connected to the heads and releasably drawing the heads into fluid-tight sealing engagement with said opposite ends;

an intermediate conduit extending between the end plates outside of and alongside the cylinder body;

end conduits extending outwardly from the heads and releasably coupled to the opposite ends of the intermediate conduit, each end conduit and its associated opposite end of the intermediate conduit extending through the end plate of the associated head;

inlet conduits respectively interconnecting the outlet ports and the end conduits at the opposite ends of the cylinder; and mixing valves in the inlet conduits.

17. The apparatus of claim 16, wherein each end plate and its associated end and inlet conduits are secured together as an end unit; and wherein the fasteners releasably interconnect the end units to each other and releasably sealingly connect the end conduits to the intermediate conduit and the cylinder heads to the cylinder body.

18. The apparatus of claim 16, wherein the end conduit extending from one of the end plates is a first supporting leg; and wherein second and third supporting legs extend endwardly from the same end plate as the first supporting leg and in triangular relation thereto.

19. A portable apparatus for mixing a liquid concentrate with a liquid diluent and for dispensing a mixture thereof, comprising:

a mixing chamber;

a cylinder having an imperforate cylinder body and opposed first and second cylinder heads defining a compartment in the cylinder, each of the cylinder heads having first and second ports, the second ports of both cylinder heads being in liquid communication with the mixing chamber;

a piston in the cylinder body reciprocally movable between the cylinder heads and dividing the compartment into diluent and concentrate chambers respectively in liquid communication with their adjacent first and second ports, a funnel connected to the first port in the second cylinder head;

a source of diluent under pressure connected to the first port in the first cylinder head; and a liquid dispensing device connected to the mixing chamber.

20. The apparatus of claim 19, wherein there are vertically supporting legs extending endwardly from the first cylinder head.

21. The apparatus of claim 19, wherein there are horizontally supporting legs extending transversely, from the first and second cylinder heads.

22. The apparatus of claim 19, wherein there are vertically supporting legs extending endwardly from the first cylinder head; and wherein there are horizontally supporting legs extending transversely from the first and second cylinder heads.

23. The apparatus of claim 19, wherein there is an opening and closing valve attached between the funnel and the first port in the second cylinder head.

24. The apparatus of claim 19, wherein there is a hose connected to the source of diluent under pressure and releasably connected to the first port in the first cylinder head.

25. The apparatus of claim 19, wherein the piston is free to reciprocate in the cylinder without being biased in either direction.

26. A portable apparatus for mixing a liquid concentrate with a liquid diluent and for dispensing a mixture thereof, comprising:

a mixing chamber;

a cylinder having an imperforate cylinder body and opposed first and second cylinder heads defining a compartment in the cylinder, each of the cylinder heads having first and second ports, the second ports of both cylinder heads being in liquid communication with the mixing chamber;

a piston in the cylinder body reciprocally movable between the cylinder heads and dividing the compartment into diluent and concentrate chambers respectively in liquid communication with their adjacent first and second ports, the piston being free to gravitate from the second cylinder head toward the first cylinder head when the apparatus is in a filling position with the cylinder upright, the concentrate chamber above the diluent chamber, and the fluid pressure above the piston greater than the fluid pressure below the piston;

means for admitting liquid concentrate gravitationally into the concentrate chamber through the first port in the second cylinder head thereby causing the piston to gravitate toward the first cylinder head when the apparatus is in said filling position;

means for delivering liquid diluent under pressure into the diluent chamber through the first port in the first cylinder head when the apparatus is in an operating position with the cylinder horizontal for causing the diluent in the diluent chamber to move the piston toward the second cylinder head and thereby moving liquid concentrate from the concentrate chamber out of the second port of the second cylinder head into the mixing chamber and for forcing diluent from the diluent chamber out of the second outlet port of the first cylinder head into the mixing chamber; and a liquid dispensing device connected to the mixing chamber.

27. The apparatus of claim 26, wherein the admitting means is a funnel.

28. The apparatus of claim 26, wherein the delivery means is a hose connected to a source of liquid diluent under pressure.

29. A portable apparatus for mixing and spraying a mixture of first and second fluids, comprising:

a cylinder having a transparent cylinder body;

opposite first and second radial end plates each including cylinder heads releasably sealed to the body, each plate having oppositely extending upper and lower radial flanges, the lower flanges constituting main supporting legs, each upper flange having a pair of oppositely facing, outwardly open notches, the first cylinder head having a concentric first fluid outlet and an eccentric first fluid inlet, the second cylinder head having a concentric second fluid outlet and an eccentric second fluid inlet, the cylinder being adapted to receive the first fluid pressurized through the first inlet and the second fluid unpressurized through the second inlet;

an outlet hose wrapped around the upper flanges in the notches thereof;

a piston in the cylinder being movable toward the second cylinder head under pressure of the first fluid thereby to place the second fluid under pressure and force it from the second outlet, the pressurized first fluid being also thereby forced out of the first outlet;

a perforated outlet nipple extending into the cylinder from the second outlet;

an intermediate conduit extending alongside the cylinder body, and having opposite ends adjacent to the upper radial flanges;

opposite first and second end conduits extending through the upper radial flanges in slideably sealingly coupled relation to the opposite ends of the intermediate conduit and also extending endwardly from the end plates; and a cap on the first end conduit and forming a first auxiliary supporting leg extending from the second end plate;

an outlet fitting on the second end conduit and connected to the hose;

opposite first and second inlet conduits respectively interconnecting the first and second end conduits and the first and second fluid outlets and establishing fluid communication therebetween;

mixing valves in the end conduits, the pressurized first fluid being conducted from the cylinder through the first inlet conduit, the first end conduit, and the intermediate conduit to the second end conduit, the pressurized second fluid being conducted from the cylinder through the second fluid inlet conduit to the second end conduit wherein the first and second fluids are mixed;

second and third auxiliary supporting legs extending from the first cylinder head on the opposite ends of the first outlet from and in triangular relation with the first leg;

the first end conduit the first inlet conduit, and the first cylinder head being secured together as a first unit of a supporting framework for the cylinder body, the second end conduit, the second inlet conduit, and the second cylinder head being secured together as a second unit of the supporting framework; and fastening rods releasably interconnecting the end plates and drawing the heads into fluid-tight engagement with the cylinder body and the end conduits into fluid-tight coupled relation with the intermediate conduit.

* * * * *